US006629827B2

(12) United States Patent
Chou

(10) Patent No.: US 6,629,827 B2
(45) Date of Patent: Oct. 7, 2003

(54) SMALL SIZE AIR COMPRESSOR

(76) Inventor: John Chou, 6F-1, No. 41, Alley 4, Lane 345, Sec. 4, Jen-Ai Rd., Taipei City (TW)

( * ) Notice: Subject to any disclaimer, the term of this patent is extended or adjusted under 35 U.S.C. 154(b) by 81 days.

(21) Appl. No.: 09/935,651

(22) Filed: Aug. 24, 2001

(65) Prior Publication Data

US 2003/0039564 A1 Feb. 27, 2003

(51) Int. Cl.[7] ..... F04B 17/00; F04B 35/00
(52) U.S. Cl. ..... 417/415; 417/368
(58) Field of Search ..... 417/410.5, 366, 417/415, 234, 313, 368; 418/152; 62/420, 262, 476; 60/517

(56) References Cited

U.S. PATENT DOCUMENTS 3,650,639 A * 3/1972 Greene et al. ..... 417/368
3,740,966 A * 6/1973 Pravda ..... 62/476
3,802,216 A * 4/1974 Brandimarte ..... 62/262
4,140,439 A * 2/1979 Imasu ..... 417/313
4,187,058 A * 2/1980 Fish ..... 417/234
4,413,473 A * 11/1983 Moscrip ..... 60/517
4,627,798 A * 12/1986 Thomas ..... 417/415
5,182,915 A * 2/1993 Iida et al. ..... 62/89
5,947,712 A * 9/1999 Vlegas et al. ..... 418/152
6,129,524 A * 10/2000 Woolenweber et al. ..... 417/366
6,210,132 B1 * 4/2001 Shilnoki et al. ..... 417/410.5
6,401,483 B1 * 6/2002 Kopp ..... 62/42

FOREIGN PATENT DOCUMENTS

DE 0752562 * 8/1997 ..... F24F/5/00

* cited by examiner

*Primary Examiner*—Teresa Walberg
*Assistant Examiner*—L. Fastovsky
(74) *Attorney, Agent, or Firm*—Rosenberg, Klein & Lee

(57) ABSTRACT

An improved small size air compressor consists of a casing, a high pressure air generator, a power cord set and an air duct set. The high pressure air generator couples with a radiator for effectively dispersing heat generated by the high pressure air generator during operation to allow the high pressure air generator achieving optimal effect.

2 Claims, 5 Drawing Sheets

SMALL SIZE AIR COMPRESSOR

BACKGROUND OF THE INVENTION (1) Field of the Invention

The present invention relates to an improved small size air compressor and particularly a small size air compressor equipped with radiator.

(2) Description of the Prior Art

Air compressors known in the art, such as the one disclosed in Taiwan patent application No. 086211875 "Multi-functional air compressor" mainly consist of:

a motor to supply power output is fixedly located on a mounting board and has a spindle with a front end attached to a gear to drive a driven gear located beneath;

the mounting board engaged with a cylinder body having two round ports for holding and mounting the motor and driven gear;

the driven gear which is a positive gear has a concentric shaft extended from an inner end surface to mount on the mounting board and an eccentric shaft engaging with an aperture located at one end of a linkage rod;

a piston has the periphery coupled to a seal ring and a lower end pivotally engaged with an upper end of the linkage rod for receiving the transmission from the linkage rod to move in the cylinder body to compress air; and the cylinder body for housing the piston to compress and discharge air.

During air compression processes the piston moves in the cylinder to compress air. The cylinder will generate heat because of the motion of the piston. For a small size air compressor to deliver high pressure air, the piton has to move very fast at very high frequency in the cylinder. As a result, even more heat will be generated. If the heat generated in the cylinder not being dispersed effectively and timely, the mechanical parts might be damaged and broken down. It will impact the operation of the air compressor.

SUMMARY OF THE INVENTION

Accordingly, the primary object of the invention is to resolve the foregoing disadvantages. The invention aims to provide an improved small size air compressor that has a radiator mounted to the cylinder for effectively dispersing the heat generated by the air compressor during operation to avoid cylinder overheat and to maintain proper operation and achieve optimal effect of the air compressor.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
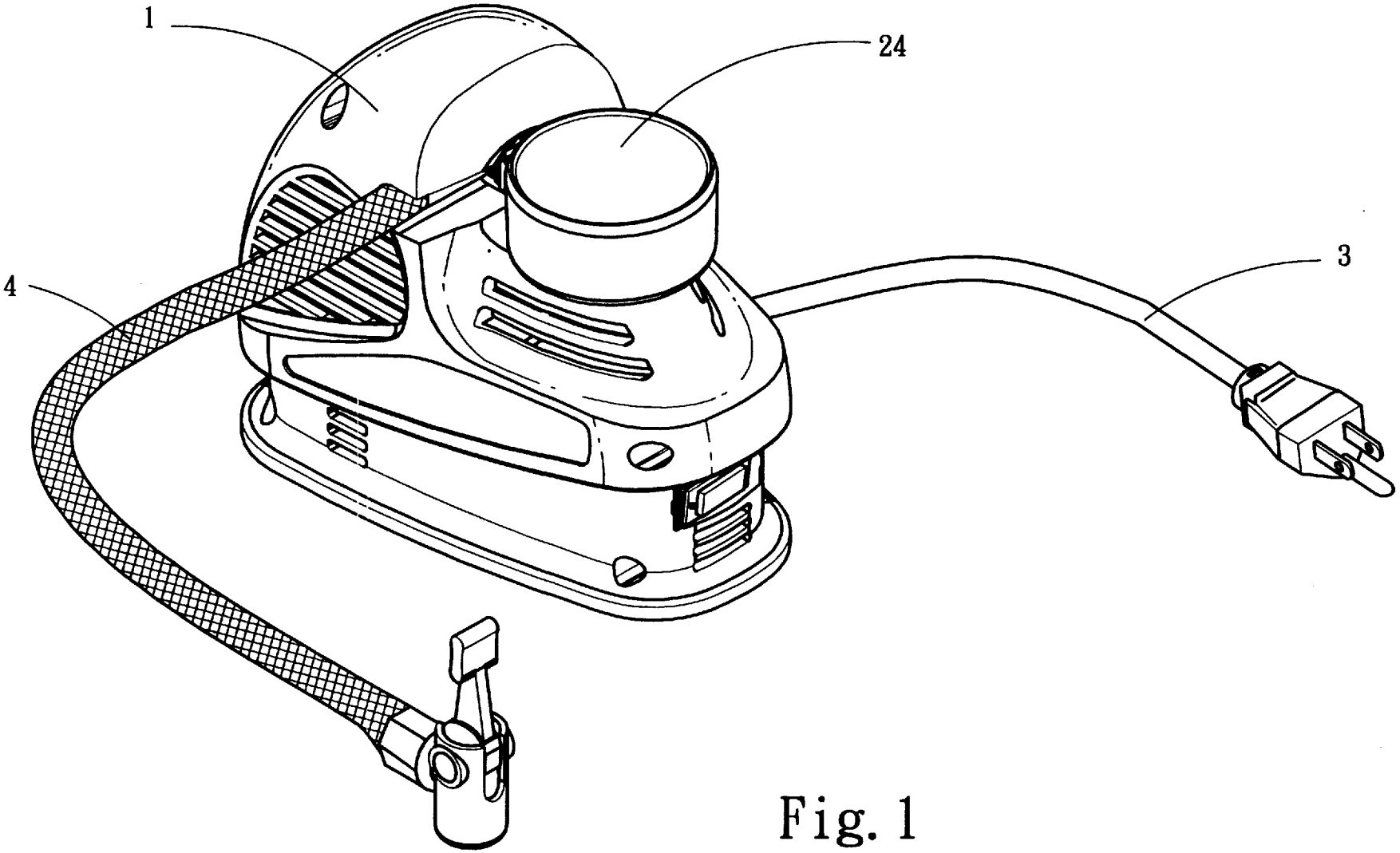
FIG. 1 is a perspective view of the present invention.
Figure 2:
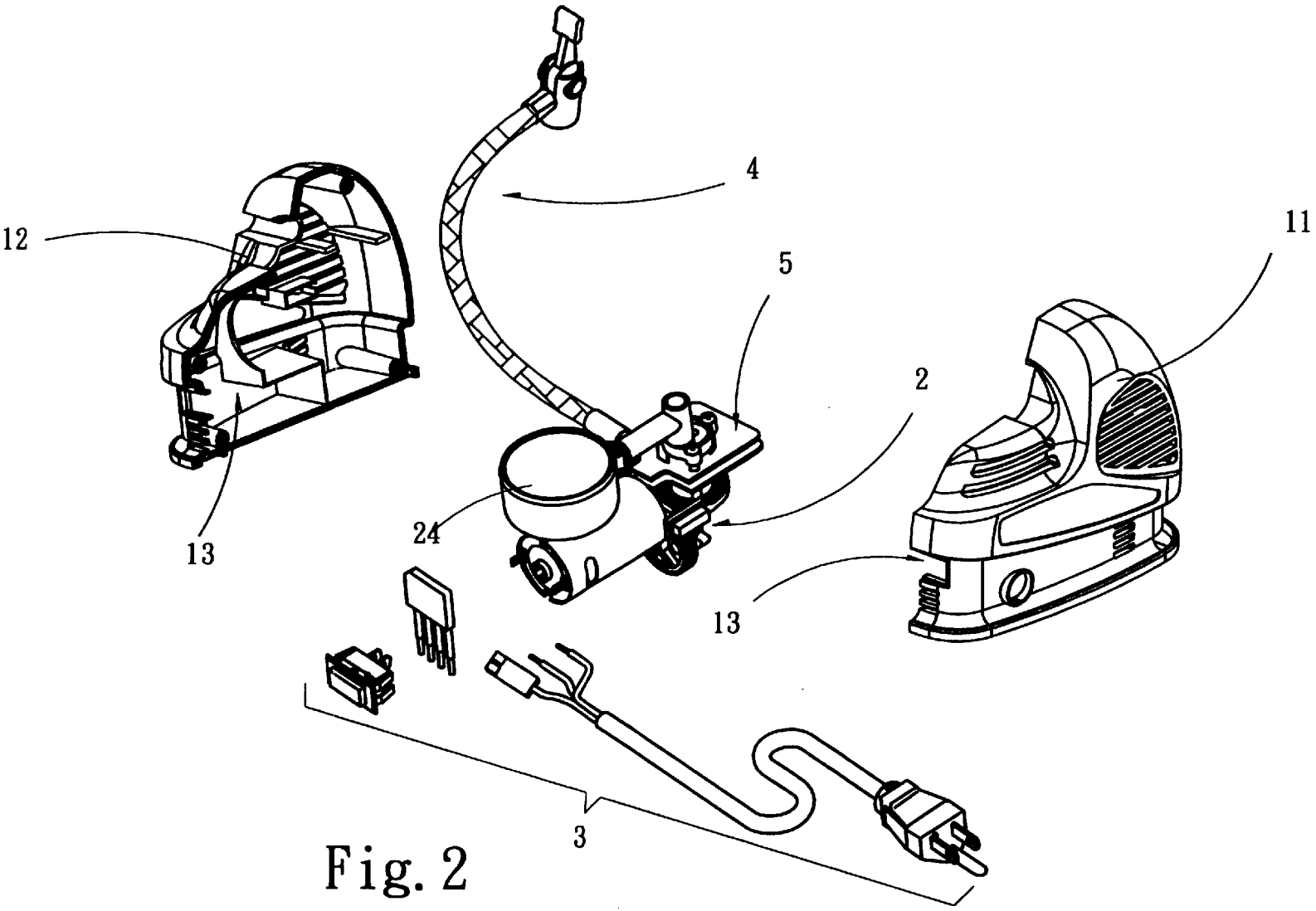
FIG. 2 is an exploded view of the present invention.

Referring to FIGS. 1, and 2, the invention consists of a casing 1, a high pressure air generator 2, a power cord set 3 and an air duct set 4. The casing 1 includes a left casing 11 and a right casing 12 and a housing chamber 13 formed therebetween for housing the high pressure air generator 2, power cord set 3 and air duct set 4. The power cord set 3 and air duct set 4 connect respectively to the high pressure air generator 2, and run through the left casing 11 and right casing 12 to link the power supply and to deliver pressure air for use.

Figure 3A:
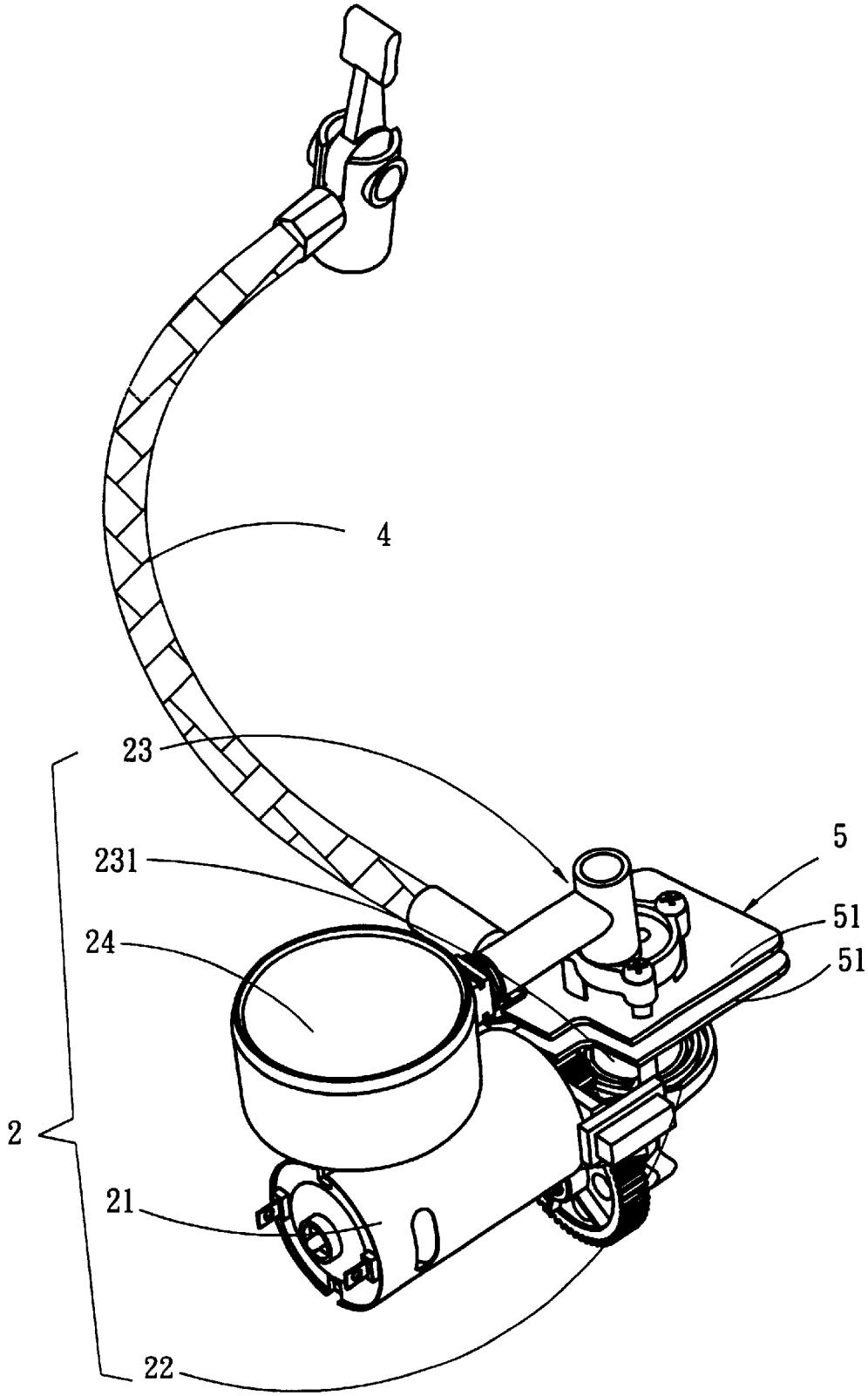
FIG. 3A is a perspective view of a high pressure air generator of the present invention.
Figure 3B:
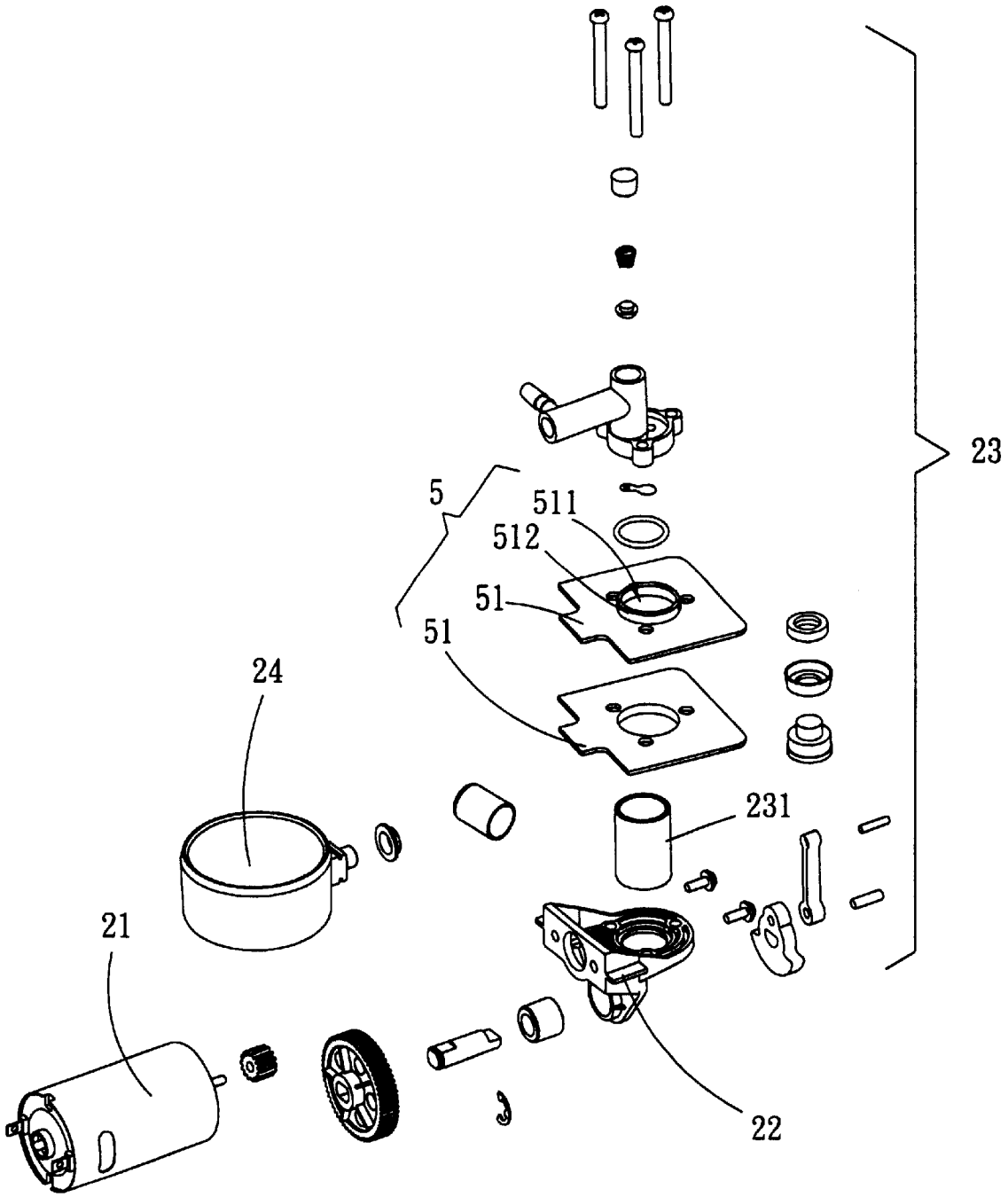
FIG. 3B is an exploded view of a high pressure air generator of the present invention.
Figure 4:
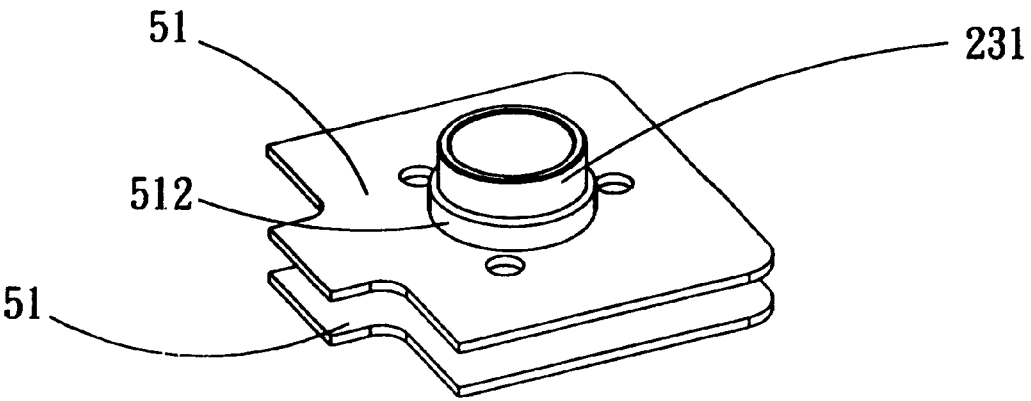
FIG. 4 is a schematic view of a radiator coupled with a cylinder.

Referring to FIGS. 3A and 3B, the high pressure air generator 2 includes a motor 21, a bracket 22 located behind the motor 21 for mounting a cylinder set 23. The cylinder set 23 is driven by the motor 21 and connects to the air duct set 4, and further connects to a pressure gauge 24 located outside the casing 1 for indicating output air pressure value delivered by the high pressure air generator 2. The high pressure air generator 2 also couples with a radiator 5 for effectively dispersing the heat generated by the high pressure air generator 2 during operation. The radiator 5 has a plurality of radiator fins 51 (or other equivalent elements) which have an opening 511 and a lip ring 512 around the opening 511 for coupling with an air cylinder 231 of the cylinder set 23 of the high pressure air generator 2 (also referring to FIG. 4). The radiator fins 51 thus can expand the radiating area of the air cylinder 231 to disperse heat effectively.

When the high pressure air generator 2 is operating, the heat generated by the cylinder set 23 will be transmitted by "thermal conduction" through the lip ring 512 to the radiator fins 51 to disperse effectively thereby to prevent the cylinder set 23 from overheating and allow the high pressure air generator 2 to achieve optimal effect.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. An improved small size air compressor, comprising:

a casing;

a high pressure air generator located in the casing:

a power cord set linked to the high pressure air generator and exposed outside the casing;

an air duct set linked to the high pressure air generator and exposed outside of the casing; and a radiator coupled with the high pressure air generator for dispersing heat generated by the high pressure air generator during operation thereof to allow the high pressure air generator to achieve an optimal effect, the radiator further including a plurality of radiator fins having an opening and a lip ring surrounding the opening for coupling with the cylinder set.

2. The improved small size air compressor of claim 1, wherein the high pressure air generator includes at least a motor, a bracket located behind the motor for mounting a cylinder set, the cylinder set being driven by the motor and connecting a pressure gauge to indicate the air pressure value output by the high pressure air generator.

* * * * *